US010943541B1

(12) United States Patent
Tan et al.

(10) Patent No.: US 10,943,541 B1
(45) Date of Patent: Mar. 9, 2021

(54) DIFFERENTIATING VOLTAGE DEGRADATION DUE TO AGING FROM CURRENT-VOLTAGE SHIFT DUE TO TEMPERATURE IN DISPLAYS

(71) Applicant: Apple Inc., Cupertino, CA (US)

(72) Inventors: Junhua Tan, Saratoga, CA (US); Hsin-Ying Chiu, San Jose, CA (US); Sun-Il Chang, San Jose, CA (US); Yunhui Hou, San Jose, CA (US); Jie Won Ryu, Santa Clara, CA (US); Hyunwoo Nho, Palo Alto, CA (US); Weichuan Yao, San Diego, CA (US); Shiping Shen, Cupertino, CA (US); Injae Hwang, Cupertino, CA (US); Hyunsoo Kim, Mountain View, CA (US); Myungjoon Choi, Sunnyvale, CA (US); Shengkui Gao, San Jose, CA (US); Chaohao Wang, Sunnyvale, CA (US); Kingsuk Brahma, Mountain View, CA (US); Jesse Aaron Richmond, San Francisco, CA (US); Myung-Je Cho, San Jose, CA (US); Changki Min, San Jose, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/556,037

(22) Filed: Aug. 29, 2019

Related U.S. Application Data

(60) Provisional application No. 62/725,929, filed on Aug. 31, 2018.

(51) Int. Cl.
*G09G 5/00* (2006.01)
*G09G 3/3258* (2016.01)
(Continued)

(52) U.S. Cl.
CPC ..... *G09G 3/3258* (2013.01); *G09G 3/32* (2013.01); *G09G 3/3233* (2013.01); *G09G 2320/041* (2013.01); *G09G 2320/045* (2013.01)

(58) Field of Classification Search
USPC ..... 345/214
See application file for complete search history.

(56) References Cited

U.S. PATENT DOCUMENTS 8,514,153 B2 8/2013 Kohno et al.
9,351,368 B2 5/2016 Azizi et al.
(Continued)

*Primary Examiner* — Deeprose Subedi
(74) *Attorney, Agent, or Firm* — Fletcher Yoder, P.C.

(57) ABSTRACT

Current-voltage shift determination circuitry of a processing core complex coupled to the electronic display determines total current-voltage shift values at a pixel. The current-voltage shift determination circuitry then determines temperature-based current-voltage shift values at the pixel. The current-voltage shift determination circuitry extracts the temperature-based current-voltage shift values from the total current-voltage shift values to determine age-based voltage degradation values. Display compensation circuitry of the processing core complex adjusts display of image data by the pixel based on the age-based voltage degradation values. In this manner, voltage degradation due to pixel aging may be determined separately from current-voltage shift due to temperature, and, as such, be more accurately compensated for, resulting in better display of image data. Compensation may thus be performed based on the age of the pixels and a sensed temperature at the pixels, instead of by constantly sensing current across the diodes of the pixels.

20 Claims, 6 Drawing Sheets

(51) Int. Cl.
*G09G 3/32* (2016.01)
*G09G 3/3233* (2016.01)

(56) References Cited

U.S. PATENT DOCUMENTS

| | | | | |
|---|---|---|---|---|
| 9,530,352 | B2 | 12/2016 | Nathan et al. | |
| 2010/0225634 | A1* | 9/2010 | Levey | G09G 3/3208 345/212 |
| 2016/0086548 | A1 | 3/2016 | Maeyama | |

* cited by examiner

DIFFERENTIATING VOLTAGE DEGRADATION DUE TO AGING FROM CURRENT-VOLTAGE SHIFT DUE TO TEMPERATURE IN DISPLAYS

CROSS-REFERENCE TO RELATED APPLICATIONS

This application claims the benefit of U.S. Provisional Application No. 62/725,929, entitled "Differentiating Voltage Degradation Due to Aging from Current-Voltage Shift Due to Temperature in Displays," filed on Aug. 31, 2018, which is incorporated herein by reference in its entirety for all purposes.

BACKGROUND

The present disclosure relates generally to electronic displays and, more particularly, to determining voltage degradation to due aging of pixels of the electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such light emitting diode (LED) displays, are commonly used in a wide variety of electronic devices, including such consumer electronics as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g. pixels) arranged in a matrix to display an image that may be viewed by a user. Individual pixels of an LED display may generate light as current is applied to each pixel. Current may be applied to each pixel by programming a voltage to the pixel that is converted by circuitry of the pixel into the current. The circuitry of the pixel that converts the voltage into the current may include, for example, thin film transistors (TFTs). However, certain operating conditions, such as aging or temperature, may affect the amount of current applied to a pixel when applying a certain voltage.

In particular, at a given age of a pixel, temperature may cause light output of the pixel to vary. The age of the pixel may be referred to as the overall time (e.g., over the lifetime of the pixel) that the pixel has been used or activated. That is, a change in temperature may cause a change in the current-voltage relationship of the pixel. The current-voltage relationship of the pixel refers to the relationship between applying a current at the pixel and the voltage that results over the diode of the pixel, which determines the amount of light (or brightness) emitted by the diode. As an example, when the pixel has been used for one year (e.g., the pixel has an age of one year), applying 5 Volts (V) at the pixel when the temperature at the pixel is 70 degrees Fahrenheit, may result in 5 milliamps (mA) at the diode. However, at the same age of the pixel (e.g., one year), applying the same 5 V at the pixel when the temperature at the pixel is 80 degrees Fahrenheit may result in 4.5 mA at the diode. This reduction in resulting voltage, or change in the current-voltage relationship of the pixel, may be referred to as a current-voltage shift at the pixel.

Moreover, at any given temperature at the pixel, the age of the pixel may also cause light output of the pixel to vary. That is, a change in age of the pixel may cause a change in the current-voltage relationship of the pixel. Using the same example above, when the pixel has been used for one year, applying 5 V at the pixel when the temperature at the pixel is 70 degrees Fahrenheit, may result in 5 mA at the diode. However, when the pixel has been used for two years, applying the same 5 V at the pixel when the temperature is the same (e.g., 70 degrees Fahrenheit) may result in 4.7 mA at the diode. This reduction in resulting voltage may be referred to as voltage degradation of the pixel.

Because both changes in temperature at the pixel and aging of the pixel may cause changes to light output of the pixel, it may be difficult to attribute the change in light output of the pixel due to a change in age of the pixel separate from the change in light output of the pixel due to a change in temperature at the pixel.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to compensating for current-voltage shift in pixels of an electronic display. The disclosure may be used in connection with a variety of self-emissive electronic displays, including, for example, light emitting diode (LED) displays, such as organic light emitting diode (OLED) displays, active matrix organic light emitting diode (AMOLED) displays, or micro LED (μLED) displays. Individual pixels of an LED display may generate light based at least in part on a current applied to each pixel. The current may be applied to each pixel by programming a voltage to the pixel, which may be converted in the pixel into the current that is applied to the pixel. The conversion of the voltage into current may be regulated by circuitry that includes, for example, thin film transistors (TFTs). Since the behavior of the circuitry of the pixels may change over time from aging of the pixels, non-uniform temperature gradients, or other factors, the voltages applied to the pixels across the display may be adjusted to compensate for these variations, thereby improving image quality by reducing visible image artifacts due to pixel non-uniformity. The non-uniformity of pixels in a display may vary between devices of the same type (e.g., two similar phones, tablets, wearable devices, or the like), may vary over time and usage (e.g., due to aging and/or degradation of the pixels or other components of the display), and/or may vary with respect to temperatures, as well as in response to additional factors, such as electromagnetic interference (EMI) from other electronic components.

Pixels of the electronic display often operate at different temperatures (e.g., due to operation of circuitry located near the display, time of operation, body heat from a user, ambient heat or cold sources, and/or sunlight). As such, to more accurately determine voltage degradation of the pixel due to aging, it may be useful to differentiate the current-voltage shift at the pixel due to temperature change. In particular, current-voltage shift determination circuitry of a processing core complex coupled to the electronic display may determine total current-voltage shift values at a pixel (e.g., which may include both voltage degradation due to aging of the pixel and current-voltage shift due to temperature change at the pixel). The current-voltage shift determination circuitry may then determine temperature-based current-voltage shift values at the pixel. The current-voltage shift determination circuitry may extract the temperature-based current-voltage shift values from the total current-voltage shift values to determine age-based voltage degradation values. Display compensation circuitry of the processing core complex may adjust display of image data by the pixel based on the age-based voltage degradation values. In this manner, voltage degradation due to pixel aging may be determined separately from current-voltage shift due to temperature, and, as such, be more accurately compensated for, resulting in better display of image data. Compensation may thus be performed based on the age of the pixels and a sensed temperature at the pixels, instead of, for example, by constantly sensing current across the diodes of the pixels.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
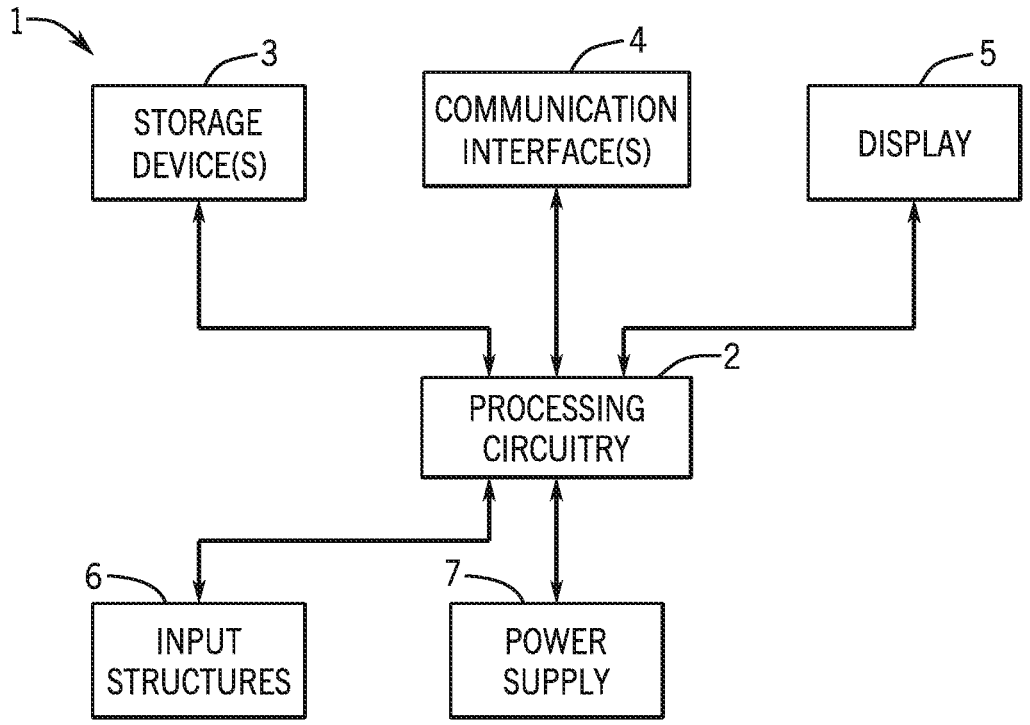
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based at least in part on the image data. By programming different pixels with different image data, graphical content including images, videos, and text can be displayed.

Display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on pixels of the display at a first time could appear to be different at a second time due to the variations in temperature and/or pixel aging. Specifically, a pixel emits an amount of light, gamma, or gray level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations in temperature and/or pixel aging may affect a pixel by, for example, changing the resulting current across the diode when applying the target voltage. Without appropriate compensation, these variations could produce undesirable visual artifacts.

Accordingly, the techniques and systems described below may accurately and separately attribute current-voltage shift of the pixels of the display to operational variations, including temperature and pixel aging variations, to better compensate for the operational variations. In particular, current-voltage shift determination circuitry may determine total current-voltage shift values based on voltage differences between voltages that cause certain current values to be measured over diodes of the pixels at different ages of and temperatures at the pixels. The current-voltage shift determination circuitry may then apply a temperature correlation factor and an aging correlation factor to the voltage degradation values to determine voltage degradation values attributable to aging at the pixels. The temperature correlation factor may be a correlation coefficient that expresses the change in current-voltage shift values attributable to temperature variation between different current values. Similarly, the aging correlation factor may be a correlation coefficient that expresses the change in voltage degradation values attributable to aging of the pixels between different current values. Display compensation circuitry may adjust voltage supplied to the pixels based on the voltage degradation values to compensate for voltage degradation due to aging of the pixels.

In some embodiments, the current-voltage shift determination circuitry may apply the temperature correlation factor and the aging correlation factor to the total current-voltage shift values to determine temperature-based current-voltage shift values attributable to temperature variation at the pixels. The current-voltage shift determination circuitry may then extract the temperature-based current-voltage shift values from the voltage degradation values to determine the age-based voltage degradation values attributable to aging at the pixel. In cases where the temperature correlation factor varies from pixel to pixel of the display, the current-voltage shift determination circuitry may average the temperature-based current-voltage shift values of a localized pixel group, and extract the average temperature-based current-voltage shift values from the total current-voltage shift values for the localized pixel group. This may be effective because it is likely that a localized pixel group will undergo a same or similar variation in temperature.

Similarly, in cases where the varying temperature causes the current over the diodes of the pixel and pixels neighboring the pixel to change uniformly, the current-voltage shift determination circuitry may convert the temperature-based current-voltage shift values for each pixel of a localized pixel group to temperature-based current reduction values (as each pixel may generate a different current over its diode when the same voltage is applied), average the temperature-based current reduction values for the localized pixel group, and the convert the average temperature-based current reduction values to average temperature-based current-voltage shift values for each pixel of the localized pixel group. The current-voltage shift determination circuitry may then extract the average temperature-based current-voltage shift values from the total current-voltage shift values for the localized pixel group. In this manner, voltage degradation due to pixel aging may be determined separately from current-voltage shift due to temperature, and, as such, be more accurately compensated for, resulting in better display of image data. Compensation may thus be performed based on the age of the pixels and a sensed temperature at the pixels, instead of by constantly sensing current across the diodes of the pixels.

A general description of suitable electronic devices that may include a self-emissive display, such as a LED (e.g., an OLED) display, and corresponding circuitry of this disclosure is provided. An OLED represents one type of LED that may be found in the self-emissive pixel, but other types of LEDs may also be used. To help illustrate, an electronic device 1 including an electronic display 5 is shown in FIG. 1. As is described in more detail below, the electronic device 1 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 1.

The electronic device 1 may include, among other things, a processing circuitry 2, such as a system on a chip (SoC) and/or any other suitable processing circuit(s), memory or storage device(s) 3, communication interface(s) 4, a display 5, input structures 6, and a power supply 7. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components.

As depicted, the processing circuitry 2 is operably coupled with the storage device(s) 3. Thus, the processing circuitry 2 may execute instructions stored in the storage device(s) 3 to perform operations, such as generating, transmitting, and/or adjusting image data. As such, processing circuitry 2 may include one or more general purpose microprocessors, one or more application specific integrated circuits (ASICs), one or more field programmable logic arrays (FPGAs), or any combination thereof.

In addition to instructions, the storage device(s) 3 may store data to be processed by the processing circuitry 2. Thus, in some embodiments, the storage device(s) 3 may include one or more tangible, non-transitory, computer-readable mediums. The storage device(s) 3 may be volatile and/or non-volatile. For example, the storage device(s) 3 may include random access memory (RAM) and/or read only memory (ROM), rewritable non-volatile memory such as flash memory, hard drives, optical discs, and/or the like, or any combination thereof.

In some embodiments, the processing circuitry 2, in combination with the storage devices 3 (e.g., to store values associated with calculation), may receive measured pixel parameters associated with one or more data signals and, based on the measured pixel parameter, determine how to adjust a data signal to be transmitted to a pixel to facilitate compensating for non-uniform properties of that pixel.

As depicted, the processing circuitry 2 is also operably coupled with the communication interface(s) 4. In some embodiments, the communication interface(s) 4 may facilitate communicating data with another electronic device and/or a network. For example, the communication interface(s) 4 (e.g., a radio frequency system) may enable the electronic device 1 to communicatively couple to a personal area network (PAN), such as a Bluetooth network, a local area network (LAN), such as an 1622.11x Wi-Fi network, and/or a wide area network (WAN), such as a 4G or Long-Term Evolution (LTE) cellular network.

Additionally, as depicted, the processing circuitry 2 is also operably coupled to the power supply 7. In some embodiments, the power supply 7 may provide electrical power to one or more components in the electronic device 1, such as the processing circuitry 2 and/or the display 5. Thus, the power supply 7 may include any suitable source of energy, such as a rechargeable lithium polymer (Li-poly) battery and/or an alternating current (AC) power converter.

As depicted, the electronic device 1 is also operably coupled with the one or more input structures 6. In some embodiments, an input structure 6 may facilitate user interaction with the electronic device 1, for example, by receiving user inputs. Thus, the input structures 6 may include a button, a keyboard, a mouse, a trackpad, and/or the like. Additionally, in some embodiments, the input structures 6 may include touch-sensing components in the display 5. In such embodiments, the touch sensing components may receive user inputs by detecting occurrence and/or position of an object touching the surface of the electronic display 5.

In addition to enabling user inputs, the display 5 may include a display panel with one or more display pixels. As described above, the display 5 may control light emission from the display pixels to present visual representations of information, such as a graphical user interface (GUI) of an operating system, an application interface, a still image, or video content, by displaying frames based at least in part on corresponding image data. As depicted, the display 5 is operably coupled to the processing circuitry 2. In this manner, the display 5 may display frames based at least in part on image data generated by the processing circuitry 2. Additionally or alternatively, the display 5 may display frames based at least in part on image data received via the communication interface(s) 4 and/or the input structures 6.

Figure 2:
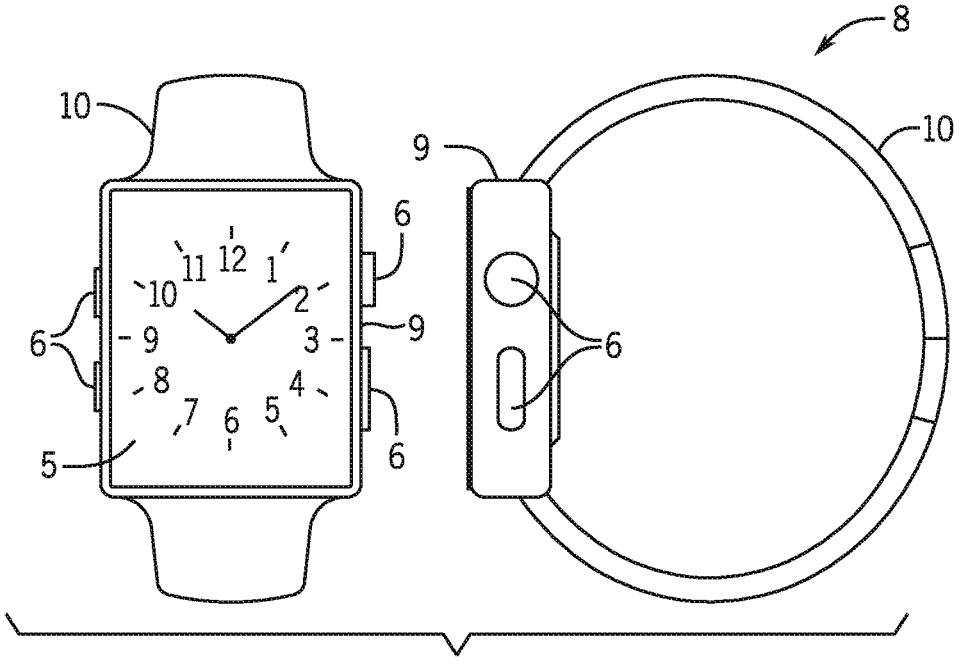
FIG. 2 is a perspective view of a watch representing an embodiment of the electronic device of FIG. 1, in accordance with an embodiment.

As may be appreciated, the electronic device 1 may take a number of different forms. As shown in FIG. 2, the electronic device 1 may take the form of a watch 8. For illustrative purposes, the watch 8 may be any Apple Watch® model available from Apple Inc. As depicted, the watch 8 includes an enclosure 9 (e.g., housing). In some embodiments, the enclosure 9 may protect interior components from physical damage and/or shield them from electromagnetic interference (e.g., house components). A strap 10 may enable the watch 8 to be worn on the arm or wrist. The display 5 may display information related to the operation of the watch 8. Input structures 6 may enable the user to activate or deactivate watch 8, navigate a user interface to a home screen, navigate a user interface to a user-configurable application screen, activate a voice-recognition feature, provide volume control, and/or toggle between vibrate and ring modes. As depicted, the input structures 6 may be accessed through openings in the enclosure 9. In some embodiments, the input structures 6 may include, for example, an audio jack to connect to external devices.

Figure 3:
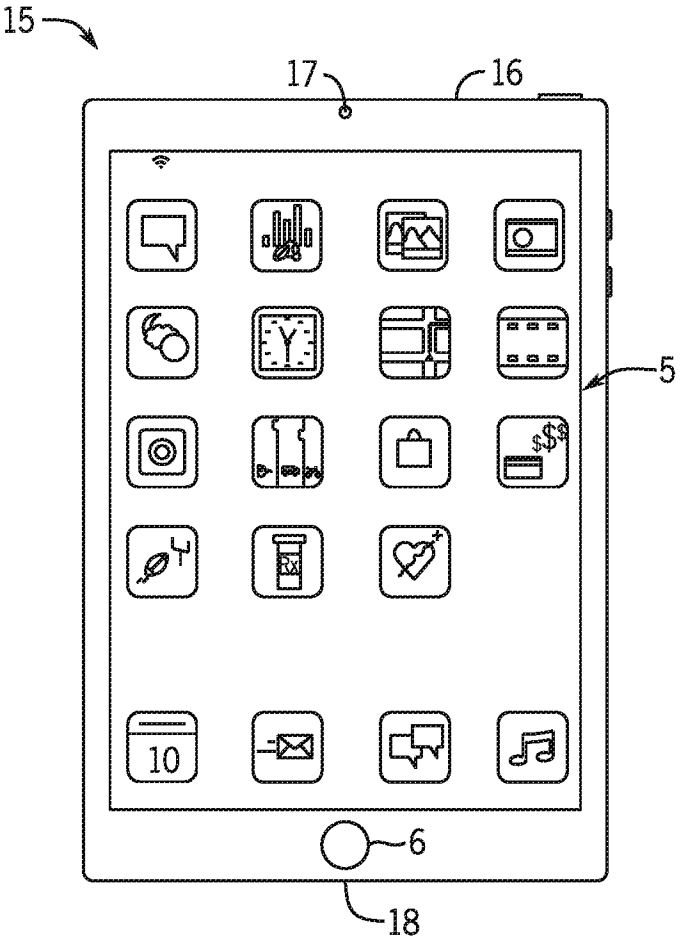
FIG. 3 is a front view of a tablet device representing an embodiment of the electronic device of FIG. 1, in accordance with an embodiment.

The electronic device 1 may also take the form of a tablet device 15, as shown in FIG. 3. For illustrative purposes, the tablet device 15 may be any iPad® model available from Apple Inc. Depending on the size of the tablet device 15, the tablet device 15 may serve as a handheld device such as a mobile phone. The tablet device 15 includes an enclosure 16 through which input structures 6 may protrude. In certain examples, the input structures 6 may include a hardware keypad (not shown). The enclosure 16 also holds the display 5. The input structures 6 may enable a user to interact with a GUI of the tablet device 15. For example, the input structures 6 may enable a user to type Short Message Service (SMS) text messages or make a telephone call. A speaker 17 may output a received audio signal and a microphone 18 may capture the voice of the user. The tablet device 15 may also include a communication interface 4 to enable the tablet device 15 to connect via a wired connection to another electronic device.

Figure 4:
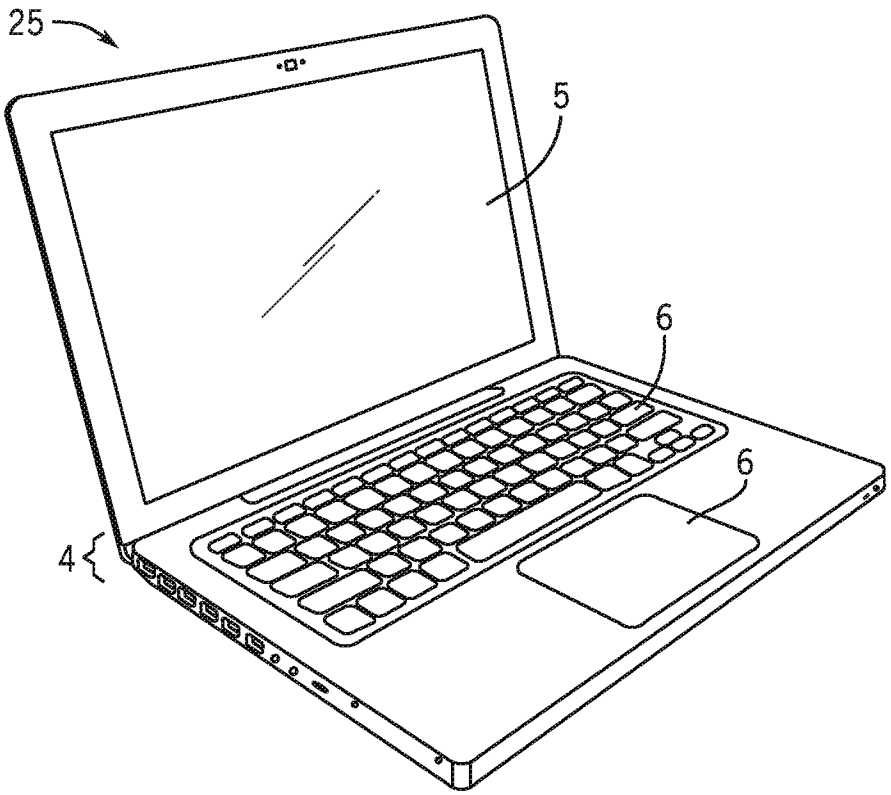
FIG. 4 is a front view of a computer representing an embodiment of the electronic device of FIG. 1, in accordance with an embodiment.

FIG. 4 illustrates a computer 25, which represents another form that the electronic device 1 may take. For illustrative purposes, the computer 25 may be any Macbook® or iMac® model available from Apple Inc. It should be appreciated that the electronic device 1 may also take the form of any other computer, including a desktop computer. The computer 25 shown in FIG. 4 includes the display 5 and input structures 6 that include a keyboard and a track pad. Communication interfaces 4 of the computer 25 may include, for example, a universal service bus (USB) connection.

Figure 5:
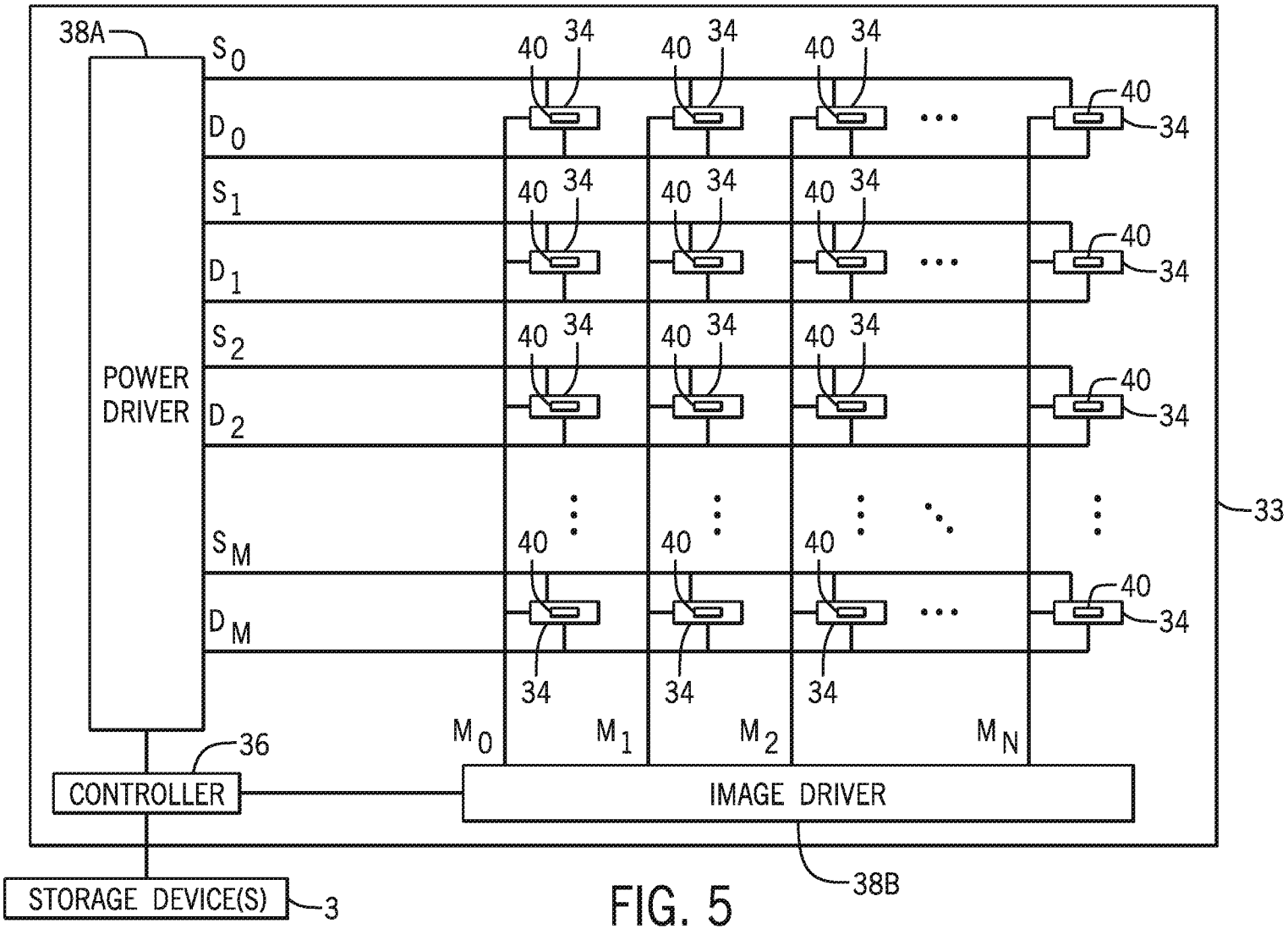
FIG. 5 is a circuit diagram of a display of the electronic device of FIG. 1, according to an embodiment of the present disclosure.

With the foregoing in mind, FIG. 5 is a circuit diagram of the display 5 of the electronic device 1 of FIG. 1, according to an embodiment of the present disclosure. As illustrated, the display 5 may include a pixel array 33 having an array of one or more of pixels 34. The display 5 may include any suitable circuitry to drive the pixels 34, including a controller 36, a power driver 38A, and an image driver 38B. The power driver 38A and image driver 38B may individually drive the pixels 34. In some embodiments, the power driver 38A and the image driver 38B may include multiple channels for independently driving groups of pixels 34. Each of the pixels 34 may include pixel circuitry, capable of receiving the electrical signals (e.g., driving signals from the power driver 38A or image driver 38B) and providing a current through a diode 40 or other suitable light emitting element to cause the light emission. For example, the diode 40 or other suitable light emitting element may include a light emitting diode, such as an organic light emitting diode.

Scan lines S0, S1, . . . , and Sm and driving lines D0, D1, . . . , and Dm may couple the power driver 38A to each pixel 34. Each pixel 34 may receive on or off instructions through the scan lines S0, S1, . . . , and Sm, and may generate programming voltages corresponding to data voltages transmitted from the driving lines D0, D1, . . . , and Dm. The programming voltages may be transmitted to each of the pixels 34 and cause emission of light according to instructions from the image driver 38B through driving lines M0, M1, . . . , and Mn. Both the power driver 38A and the image driver 38B may transmit voltage signals at programmed voltages through respective driving lines to operate each pixel 34 at a state determined by the controller 36 to emit light. Each driver 38A, 38B may supply voltage signals at a duty cycle or amplitude sufficient to operate each pixel 34.

The target brightness of each pixel 34 may be defined by the received image data. In this way, a first brightness of light may emit from a pixel 34 in response to a first value of the image data and the pixel 34 may emit a second brightness of light in response to a second value of the image data. Thus, image data may form images by generating driving signals to each individual pixel 34 that causes the pixel 34 to provide the target brightness.

The controller 36 may retrieve image data stored in the storage device(s) 3 indicative of the target brightness for colored light outputs of individual pixels 34. In some embodiments, the processing circuitry 2 may provide image data directly to the controller 36. The controller 36 may coordinate the signals provided to each pixel 34 from the power driver 38A or image driver 38B. The pixel 34 may include pixel circuitry, which may include any suitable controllable element, such as a transistor (e.g., a thin film transistor (TFT) or a p-type or n-type metal-oxide-semiconductor field-effect transistor (MOSFET)). The pixel circuitry may process the signals received from the power driver 38A or the image driver 38B, and may generate the target brightness indicated by image data.

System for Current-Voltage Shift Voltage Degradation Compensation

Figure 6:
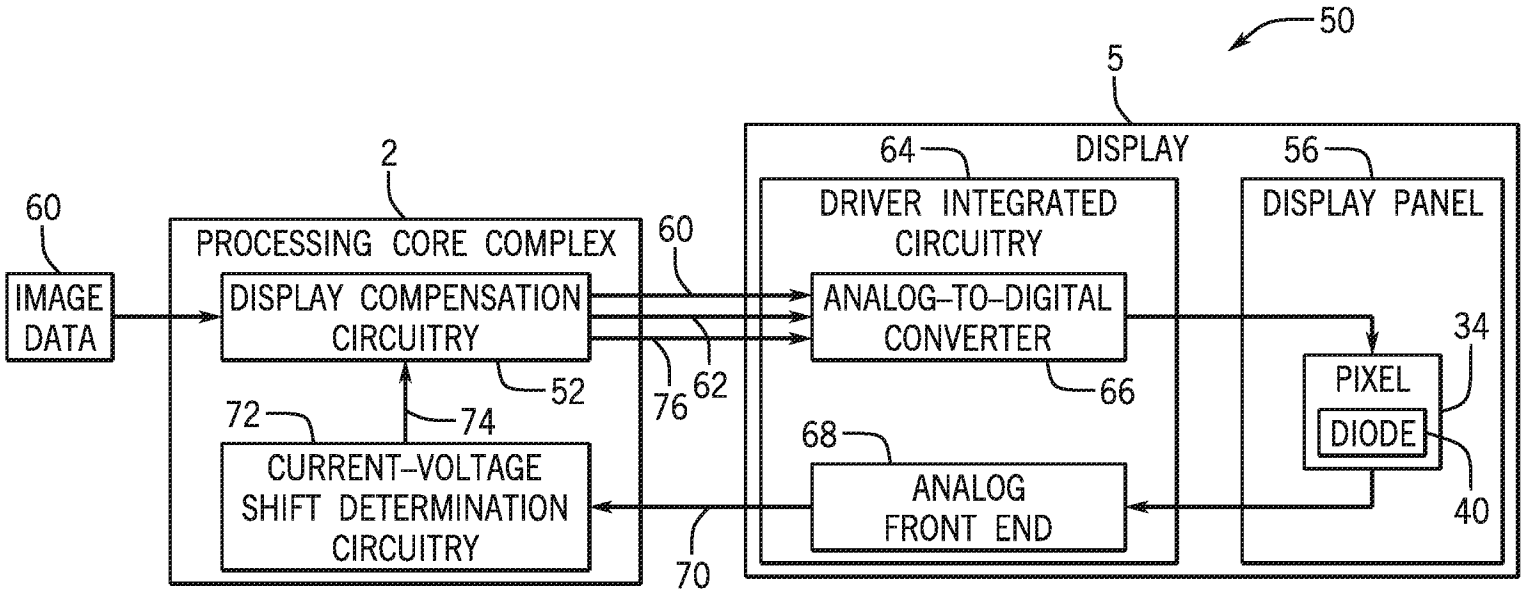
FIG. 6 is a block diagram of a system for current-voltage shift and voltage degradation compensation, according to an embodiment of the present disclosure.

FIG. 6 is a block diagram of a system 50 for current-voltage shift and voltage degradation compensation, according to an embodiment of the present disclosure. The system 50 includes the processing circuitry 2, which includes display compensation circuitry 52. As discussed above, pixels 34 of a display panel 56 of the display 5 may undergo current-voltage shift due to temperature variation at the pixels 34 and/or voltage degradation due to aging of the pixels 34. The current-voltage shift and/or voltage degradation may cause a different (e.g., decreased) current across a diode 40 of a pixel 34 than expected when a target voltage is applied. The resulting brightness or gamma level emitted by the diode 40, which is dependent on the current across the diode 40, may thus be different (e.g., lower) than expected or evidenced in previous measurements. Such differences may result in undesired image artifacts when displaying image data 60 on the display 5, negatively affecting the user experience. While a single pixel 34 is illustrated in the display panel 56 of the display 5 of FIG. 5, it should be understood that the display panel 56 may include multiple pixels 34 (e.g., arranged in an array), and that the disclosed techniques may be applied to the multiple pixels 34. Additionally, it should be understood that current-voltage shift at a pixel 34 may occur due to a variety of sources, including both current-voltage shift due to changes in temperature at the pixel 34, as well as voltage degradation due to aging of the pixel 34. As such, references to "current-voltage shift" or "total current-voltage shift" at the pixel 34 includes both current-voltage shift due to changes in temperature at the pixel 34, as well as voltage degradation due to aging of the pixel 34. References to "current-voltage shift due to temperature change," "current-voltage shift due to temperature variation," or other similar phrases, specifically address the current-voltage shift at the pixel 34 resulting from temperature changes.

The display compensation circuitry 52 may send the image data 60 to the display 5 to be displayed by the pixel 34, and send a sensing operation signal 62 that causes the display 5 to sense operational parameters of the display panel 56 and/or the pixel 34. Driver integrated circuitry 64 of the display 5 may receive the image data 60 and the sensing operation signal 62, and an analog-to-digital converter 66 of the driver integrated circuitry 64 may digitize the image data 60 when it is in an analog format. The driver integrated circuitry 64 may send signals across gate lines of the display panel 56 to cause a row of pixels 34 to become activated and programmable, at which point the driver integrated circuitry 64 may transmit the image data 60 across data lines to program the pixels 34 to display particular gray levels (e.g., individual pixel brightnesses). By supplying different pixels 34 with the image data 60 to display different gray levels, full-color images may be programmed into the pixels 34 of the display panel 56.

The driver integrated circuitry 64 may also include an analog front end (AFE) 68 that performs analog sensing of responses of the pixels 34 to data input (e.g., the image data 60). In particular, the analog front end 68 may perform sensing based on receiving the sensing operation signal 62 sent by the display compensation circuitry 52. The sensed results may be sent by the analog front end 68 as display sense feedback 70 to the processing circuitry 2 for analysis by a current-voltage shift determination circuitry 72. In particular, the display sense feedback 70 may include operational variation information of the display 5 in the form of digital information. The current-voltage shift determination circuitry 72 that may determine and/or quantify current-voltage shift of the pixel 34 based on receiving the display sense feedback 70, and attribute voltage degradation of the pixel 34 to aging of the pixel 34, current-voltage shift due to temperature variation at the pixel 34, and/or other factors that may cause current-voltage shift at the pixel 34.

For example, the sensing operation signal 62 may instruct the analog front end 68 to sense current over the diode 40 when the pixel 34 displays the image data 60 when supplied with a certain voltage. The sensed current may be sent as the display sense feedback 70 by the analog front end 68 to the display 5. If the current-voltage shift determination circuitry 72 determines that the sensed current is different than an expected (e.g., initially measured) value, then the display compensation circuitry 52 may send additional sensing operation signals 62 while supplying different (e.g., higher and higher) voltages, until the expected current is sensed by the analog front end 68 and received by the current-voltage shift determination circuitry 72. The current-voltage shift determination circuitry 72 may quantify current-voltage shift at the pixel 34 by comparing the supplied voltage that results in the expected current with the certain voltage that was originally expected to result in the expected current of the diode 40. Specifically, the current-voltage shift determination circuitry 72 may separately quantify current-voltage shift of the pixel 34 based on different operational characteristics. For example, the current-voltage shift determination circuitry 72 may separately determine voltage degradation due to aging of the pixel 34 apart from current-voltage shift of the pixel 34 due to temperature variation at the pixel 34.

The current-voltage shift determination circuitry 72 may send a signal 74 indicative of the determined current-voltage shift of the pixel 34, and more specifically, voltage degradation due to aging of the pixel 34, current-voltage shift due to temperature variation at the pixel 34, and/or current-voltage shift due to any other suitable operational characteristics of the pixel 34). The display compensation circuitry 52 may send a voltage adjustment signal 76 to the display 5 that instructs the analog-to-digital converter 66 to adjust the voltage supplied to the pixel 34 that causes the pixel 34 to display the image data 60 and compensate for the current-voltage shift of the pixel 34.

For example, at a certain age of the pixel 34, such as an initial age (e.g., zero years) at which the display 5 is at a manufacturer's facility and before the electronic device 1 has been operated by a consumer, the display compensation circuitry 52 may send first image data 60 (e.g., test image data) to the pixel 34, and instruct the analog-to-digital converter 66 to supply voltage to the pixel 34 at multiple initial voltages. The analog front end 68 may sense the resulting currents across the diode 40, and send the resulting currents as the display sense feedback 70 to the current-voltage shift determination circuitry 72. The processing circuitry 2 may save these resulting currents in a memory or storage device (such as the local memory and/or main memory storage device 3) as target or expected currents. At a later age of the pixel 34 (e.g., after which the electronic device 1 has been purchased and operated by the consumer), the display compensation circuitry 52 may send the first image data 60 (e.g., test image data) to the pixel 34, and instruct the analog-to-digital converter 66 to supply voltage to the pixel 34 at multiple voltages that result in the resulting currents across the diode 40. The current-voltage shift determination circuitry 72 may determine the differences between the multiple voltages (determined at the later age of the pixel 34) and the multiple initial voltages (determined at the initial age of the pixel 34) as current-voltage shift of the pixel 34, and the display compensation circuitry 52 may send the voltage adjustment signal 76 to compensate for these differences.

In some cases, the current-voltage shift attributable to temperature variation may be determined at an initial age (e.g., zero years) at which the display 5 is at a manufacturer's facility and before the electronic device 1 has been operated by a consumer. For example, the manufacturer may vary temperature at the pixel 34 (as well as other pixels and/or pixel groups of the display 5), and, for each temperature, determine a temperature correlation factor that relates current-voltage shift due to temperature variation at the pixel 34 corresponding to multiple resulting currents across the diode 40 of the pixel 34 (for the initial age of the pixel 34). That is, the temperature correlation factor may be a correlation coefficient that expresses change in current-voltage shift values attributable to temperature variation at the pixel 34 between different resulting current values across the diode 40 of the pixel 34. The manufacturer may then store the determined temperature correlation factors in a memory or storage device (such as the local memory and/or main memory storage device 3).

However, an aging correlation factor that relates the voltage degradation attributable to aging of the pixel 34 corresponding to multiple resulting currents across the diode 40 of the pixel 34 may be determined dynamically. That is, the aging correlation factor may be a correlation coefficient that expresses change in voltage degradation values of the pixel 34 between different resulting current values across the diode 40 of the pixel 34. For example, because each pixel 34 of the display panel 56 may experience voltage degradation at different and unique rates (e.g., because of different physical characteristics and/or manufacturing imperfections of each pixel 34), the aging correlation factor for each pixel 34 (or pixel group) may be determined periodically (e.g., once a day, once every two weeks, once every three weeks, once a month, or any other suitable period) during the lifetime of the display 5 to more accurately characterize the nature of the voltage degradation.

Figure 7:
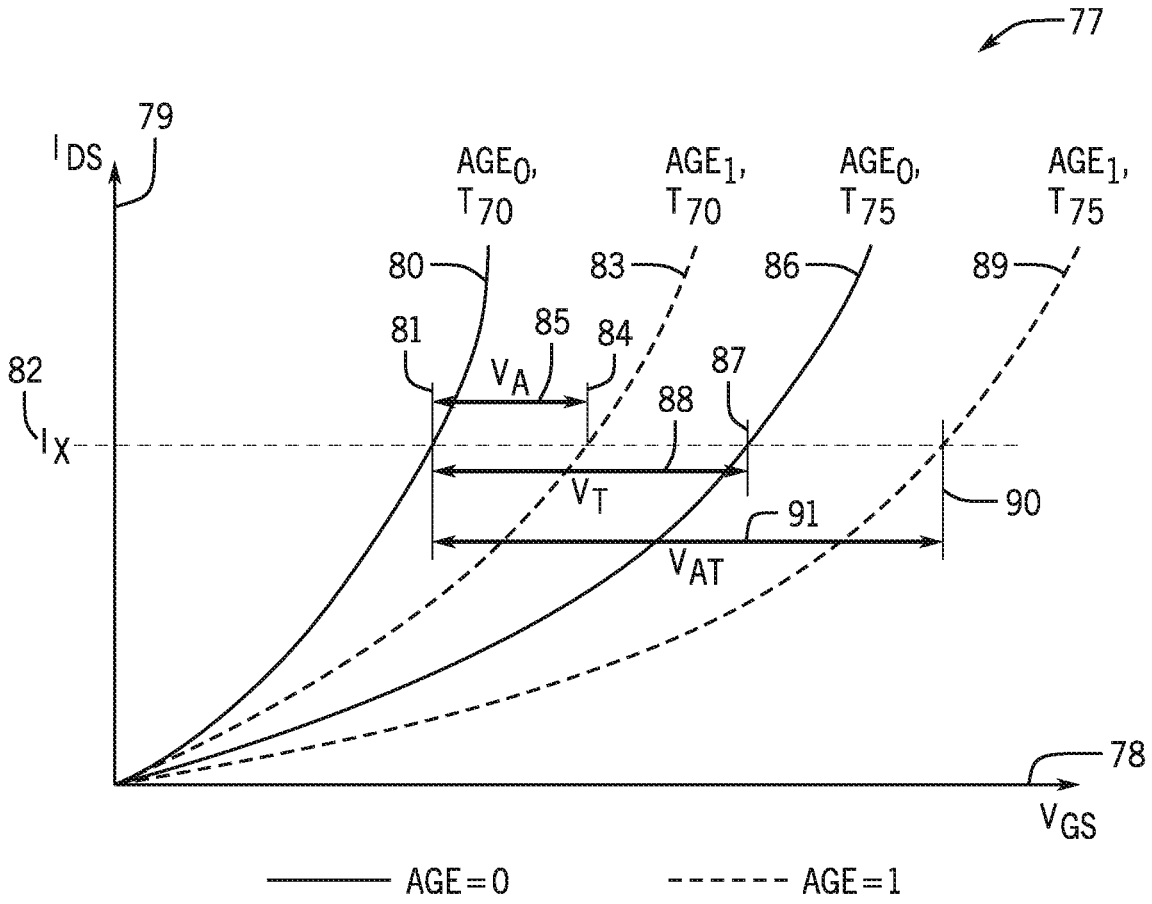
FIG. 7 is an example graph illustrating current-voltage shift and voltage degradation of a pixel of the display of FIG. 5, according to an embodiment of the present disclosure.

Voltage Degradation Due to Aging of the Pixel and Current-Voltage Shift Temperature Variation at the Pixel FIG. 7 is an example graph 77 illustrating current-voltage shift and voltage degradation of the pixel 34, according to an embodiment of the present disclosure. The graph 77 includes an abscissa or horizontal axis 78 which shows voltage supplied to the pixel 34, and specifically, voltage supplied a gate of a transistor ($V_{gs}$) of the pixel 34. The graph 77 also include an ordinate or vertical axis 79 which shows the resulting current across the diode 40 ($I_{ds}$) of the pixel 34.

A initial curve 80 illustrates the relationship between the voltage supplied to the pixel 34 ($V_{gs}$) and the resulting current across the diode 40 ($I_{ds}$) when the pixel 34 has an initial age (e.g., of approximately zero such that the pixel 34 has undergone little to no aging because it has not been used or been seldom used) and the temperature at the pixel 34 is at an initial temperature (e.g., a controlled, testing, or optimal temperature). For example, the initial curve 80 may be determined at the manufacturer's facility after the manufacturer has at least partially completed assembling the display 5 (such that voltage may be supplied to the pixel 34 and measured, and the resulting current across the diode 40 of the pixel 34 may also be measured). The pixel 34 may have undergone little to no aging, as it has been recently manufactured. The initial temperature at which the voltage is supplied to the pixel 34 and the resulting current across the diode 40 measured may be selected as any suitable temperature, such as a control temperature (e.g., between 50 and 80 degrees Fahrenheit, such as 65, 70, 72, or 75 degrees Fahrenheit) for which baseline or any other suitable tests may be run on the display 5. As illustrated, for purposes of the example graph 77, the initial temperature may be 70 degrees Fahrenheit. The initial curve 80 illustrates that a voltage 81 may be applied to realize a given current value, $I_x$ 82, across the diode 40 when the pixel is zero years of age and the temperature at the pixel 34 is 70 degrees Fahrenheit.

An aged curve 83 illustrates the relationship between the voltage supplied to the pixel 34 ($V_{gs}$) and the resulting current across the diode 40 ($I_{ds}$) when the pixel 34 has aged for a certain amount of time. For purposes of the aged curve 83, the age of the pixel 34 may be one year, though the aged curve 83 may apply to any suitable time period that causes voltage degradation of the pixel 34. The temperature at which the voltage is supplied to the pixel 34 and the resulting current across the diode 40 measured for purposes of the aged curve 83 is the same temperature at which the initial curve 80 was determined—70 degrees Fahrenheit. The aged curve 83 illustrates that a voltage 84 may be applied to realize the given current value, $I_x$ 82, across the diode 40 when the pixel is one year of age and the temperature at the pixel is 70 degrees Fahrenheit. An aged voltage difference, $V_A$ 85, illustrates the difference in voltage applied to realize the given current value, $I_x$ 82, across the diode 40 between when the pixel 34 is zero years of age and when the pixel 34 is one year of age. In particular, after one year of age, an increase of $V_A$ 85 Volts may be applied to the pixel 34 to realize the given current value, $I_x$ 82, across the diode 40, as compared to zero years of age of the pixel 34.

A temperature-varied curve 86 illustrates the relationship between the voltage supplied to the pixel 34 ($V_{gs}$) and the resulting current across the diode 40 ($I_{ds}$) when the pixel 34 is at a different temperature than the initial temperature (e.g., 70 degrees Fahrenheit). For purposes of the temperature-varied curve 86, the temperature at the pixel 34 may be 75 degrees Fahrenheit, though the temperature-varied curve 86 may apply to any suitable temperature that causes a current-voltage shift of the pixel 34. The age of the pixel 34 may be the initial age at which the initial curve 80 was determined—zero years. The temperature-varied curve 86 illustrates that a voltage 87 may be applied to realize the given current value, $I_x$ 82, across the diode 40 when the pixel is zero years of age and the temperature at the pixel is 75 degrees Fahrenheit. A temperature-varied voltage difference, $V_T$ 88, illustrates the difference in voltage applied to realize the given current value, $I_x$ 82, across the diode 40 between when the pixel 34 is at 70 degrees Fahrenheit and when the pixel 34 is at 75 degrees Fahrenheit. In particular, at 75 degrees Fahrenheit, an increase of $V_T$ 88 Volts may be applied to the pixel 34 to realize the given current value, $I_x$ 82, across the diode 40, as compared to the initial temperature of 70 degrees Fahrenheit.

An aged and temperature-varied curve 89 illustrates the relationship between the voltage supplied to the pixel 34 ($V_{gs}$) and the resulting current across the diode 40 ($I_{ds}$) when the pixel 34 has aged for a certain amount of time and the pixel 34 is at a different temperature than the initial temperature (e.g., 70 degrees Fahrenheit). For purposes of the aged and temperature-varied curve 89, the age of the pixel 34 may be one year, though the aged curve 83 may apply to any suitable time period that causes voltage degradation of the pixel 34, and the temperature at the pixel 34 may be 75 degrees Fahrenheit, though the temperature-varied curve 86 may apply to any suitable temperature that causes a current-voltage shift of the pixel 34. The aged and temperature-varied curve 89 illustrates that a voltage 90 may be applied to realize the given current value, $I_x$ 82, across the diode 40 when the pixel is one year of age and the temperature at the pixel is 75 degrees Fahrenheit. An aged and temperature-varied voltage difference, $V_{AT}$ 91, illustrates the difference in voltage applied to realize the given current value, $I_x$ 82, across the diode 40 between when the pixel 34 has an age of zero years and is at 70 degrees Fahrenheit and when the pixel 34 has an age of one year and is at 75 degrees Fahrenheit. In particular, after one year of age and at 75 degrees Fahrenheit, an increase of $V_{AT}$ 91 Volts may be applied to the pixel 34 to realize the given current value, $I_x$ 82, across the diode 40, as compared to zero years of age of the pixel 34 and the initial temperature of 70 degrees Fahrenheit.

Figure 8:
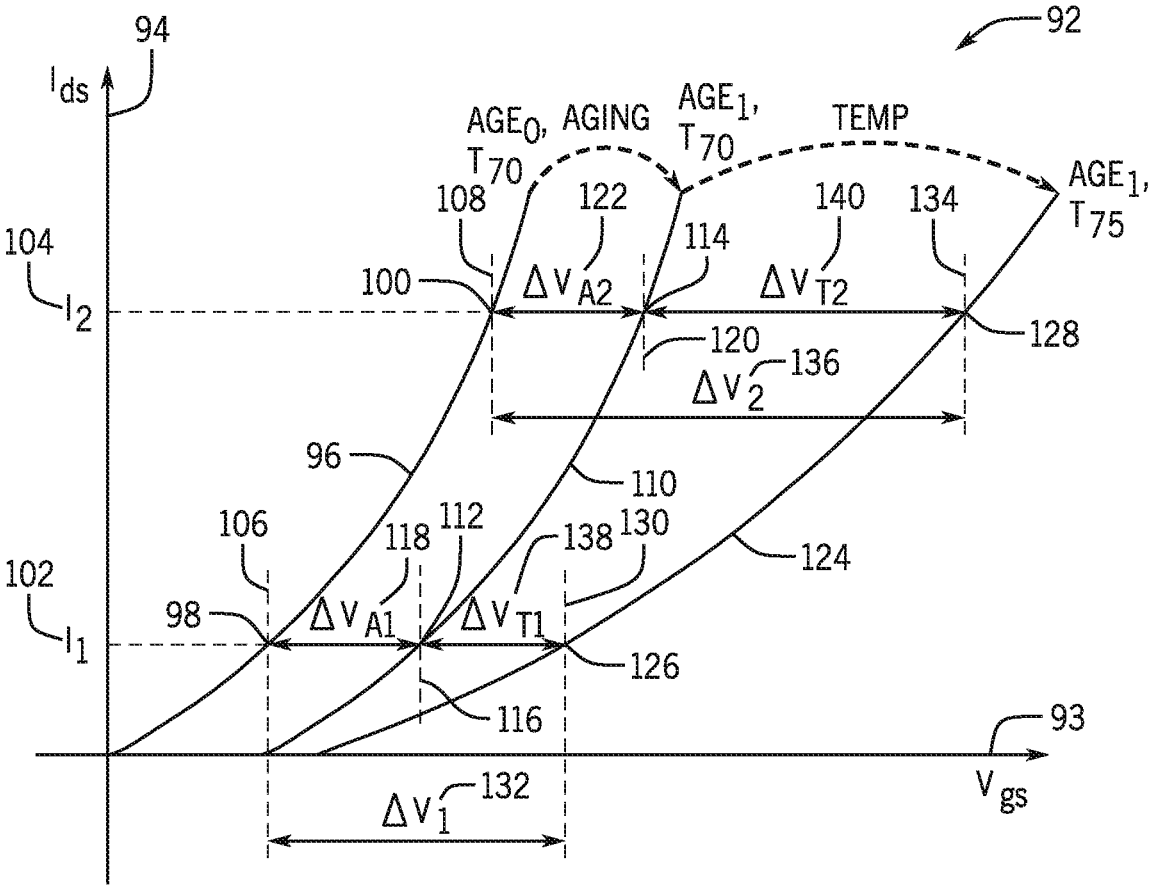
FIG. 8 is an example graph illustrating variables for determining current-voltage shift and voltage degradation compensation, according to an embodiment of the present disclosure.

FIG. 8 is an example graph 92 illustrating variables for determining current-voltage shift and voltage degradation compensation, according to an embodiment of the present disclosure. The graph 92 includes an abscissa or horizontal axis 93 which shows voltage supplied to the pixel 34, and specifically, voltage supplied a gate of a transistor ($V_{gs}$) of the pixel 34. The graph 92 also include an ordinate or vertical axis 94 which shows the resulting current across the diode 40 ($I_{ds}$) of the pixel 34.

An initial curve 96 illustrates the relationship between the voltage supplied to the pixel 34 ($V_{gs}$) and the resulting current across the diode 40 ($I_{ds}$) when the pixel 34 has an initial age (e.g., of approximately zero such that the pixel 34 has undergone little to no aging because it has not been used or been seldom used) and the temperature at the pixel 34 is at a certain temperature (e.g., a controlled, testing, or optimal temperature). For example, the initial curve 96 may be determined at the manufacturer's facility after the manufacturer has at least partially completed assembling the display 5 (such that voltage may be supplied to the pixel 34 and measured, and the resulting current across the diode 40 of the pixel 34 may also be measured). The pixel 34 may have undergone little to no aging, as it has been recently manufactured. The certain temperature at which the voltage is supplied to the pixel 34 and the resulting current across the diode 40 measured may be selected as any suitable temperature, such as a control temperature (e.g., between 50 and 80 degrees Fahrenheit, such as 65, 70, 72, or 75 degrees Fahrenheit) for which baseline or any other suitable tests may be run on the display 5.

As illustrated, the initial curve 96 is formed from at least two pairs of initial voltage-current measurements 98, 100, though any suitable number of measurements may be used to determine the initial curve 96. A first initial voltage-current measurement 98 may be based on a first (e.g., lower) current ($I_1$) 102, while a second initial voltage-current measurement 100 may be based on a second (e.g., higher) current ($I_2$) 104. In particular, the first initial voltage-current measurement 98 may be determined by adjusting the voltage supplied to the pixel 34 until the resulting current across the diode 40 of the pixel 34 is equal to the first current 102. As such, the first initial voltage-current measurement 98 includes the first current 102 and the voltage supplied to the pixel 34 to realize the first current 102 (e.g., a first initial voltage 106). Similarly, the second initial voltage-current measurement 100 may be determined by adjusting the voltage supplied to the pixel 34 until the resulting current across the diode 40 of the pixel 34 is equal to the second current 104. As such, the second initial voltage-current measurement 100 includes the second current 104 and the voltage supplied to the pixel 34 to realize the second current 104 (e.g., a second initial voltage 108).

An aging curve 110 illustrates the relationship between the voltage supplied to the pixel 34 ($V_{gs}$) and the resulting current across the diode 40 ($I_{ds}$) when the pixel 34 has reached a certain age (e.g., the pixel 34 has undergone a certain amount of aging due to use), at the certain temperature (e.g., the e.g., controlled, testing, or optimal temperature). Due to the aging undergone by the pixel 34, the relationship between the voltage supplied to the pixel 34 and the resulting current across the diode 40 of the pixel 34 has changed or degraded. That is, the pixel 34 has undergone voltage degradation. As illustrated, the aging curve 110 is formed from at least two pairs of aging voltage-current measurements 112, 114, though any suitable number of measurements may be used to determine the aging curve 110. A first aging voltage-current measurement 112 may be determined by adjusting the voltage supplied to the pixel 34 until the resulting current across the diode 40 of the pixel 34 is equal to the first current 102. The voltage supplied to the pixel 34 to realize the first current 102 (e.g., a first aging voltage 116) may be different (e.g., greater than) the first initial voltage 106 (of the first initial voltage-current measurement 98) as a result of voltage degradation of the pixel 34 due to aging of the pixel 34. This voltage difference may be referred to as a first current aging voltage difference ($\Delta V_{A1}$) 118.

Also, a second aging voltage-current measurement 114 may be determined by adjusting the voltage supplied to the pixel 34 until the resulting current across the diode 40 of the pixel 34 is equal to the second current 104. The voltage supplied to the pixel 34 to realize the second current 104 (e.g., a second aging voltage 120) may be different (e.g., greater than) the second initial voltage 108 (of the second initial voltage-current measurement 100) as a result of voltage degradation of the pixel 34 due to aging of the pixel 34. This voltage difference may be referred to as a second current aging voltage difference ($\Delta V_{A2}$) 122.

However, the first current aging voltage difference 118 and the second current aging voltage difference 122 may not be easily or conveniently determined because the voltage degradation due to aging of the pixel 34 may not be easily or conveniently separated from voltage degradation of the pixel 34 in general (which may include voltage degradation due to temperature variation at the pixel 34). And even if there is an attempt to match the temperature at the pixel 34 with the certain temperature (e.g., a controlled, testing, or optimal temperature), it may nevertheless be difficult to match other control conditions (e.g., temperature at neighboring pixels, humidity, or similar ambient conditions) at the pixel 34. Indeed, a voltage degradation curve 124 illustrates the relationship between the voltage supplied to the pixel 34 and the resulting current across the diode 40 when the pixel 34 has reached the certain age, at a temperature at the pixel 34 at which the voltage supplied to the pixel 34 and the resulting current across the diode 40 are measured, which is a different temperature than the certain temperature.

Due to the aging undergone by and the temperature variation at the pixel 34, the relationship between the voltage supplied to the pixel 34 and the resulting current across the diode 40 of the pixel 34 has changed or degraded. That is, the pixel 34 has undergone voltage degradation. As illustrated, the voltage degradation curve 124 is formed from at least two pairs of degradation voltage-current measurements 126, 128, though any suitable number of measurements may be used to determine the voltage degradation curve 124. A first degradation voltage-current measurement 126 may be determined by adjusting the voltage supplied to the pixel 34 until the resulting current across the diode 40 of the pixel 34 is equal to the first current 102. The voltage supplied to the pixel 34 to realize the first current 102 (e.g., a first degradation voltage 130) may be different (e.g., greater than) the first initial voltage 106 (of the first initial voltage-current measurement 98), as well as the first aging voltage 116 (of the first aging voltage-current measurement 112), as a result of voltage degradation of the pixel 34 due to aging of the pixel 34 and temperature variation at the pixel 34. This voltage difference may be referred to as a first current reduction voltage difference ($\Delta V_1$) 132.

Also, a second degradation voltage-current measurement 128 may be determined by adjusting the voltage supplied to the pixel 34 until the resulting current across the diode 40 of the pixel 34 is equal to the second current 104. The voltage supplied to the pixel 34 to realize the second current 104 (e.g., a second degradation voltage 134) may be different (e.g., greater than) the second initial voltage 108 (of the second initial voltage-current measurement 100), as well as the second aging voltage 120 (of the second aging voltage-current measurement 114), as a result of voltage degradation of the pixel 34 due to aging of the pixel 34 and temperature variation at the pixel 34. This voltage difference may be referred to as a second current reduction voltage difference ($\Delta V_2$) 136.

A first temperature voltage difference ($\Delta V_{T1}$) 138 may correspond to the voltage degradation of the pixel 34 due to temperature variation at the pixel 34 when the current across the diode 40 of the pixel 34 is equal to the first current ($I_1$) 102. Similarly, a second temperature voltage difference ($\Delta V_{T2}$) 140 may correspond to the voltage degradation of the pixel 34 due to temperature variation at the pixel 34 when the current across the diode 40 of the pixel 34 is equal to the second current ($I_2$) 104.

As such, the first current reduction voltage difference ($\Delta V_1$) 132 (e.g., the total voltage degradation of the pixel 34 when providing the first current ($I_1$) 102 across the diode 40 of the pixel 34) is the sum of the first temperature voltage difference ($\Delta V_{T1}$) 138 (e.g., the voltage degradation due to temperature variation at the pixel 34 when providing the first current ($I_1$) 102 across the diode 40 of the pixel 34) and the first current aging voltage difference 118 ($\Delta V_{A1}$) (e.g., the voltage degradation due to aging of the pixel 34 when providing the first current ($I_1$) 102 across the diode 40 of the pixel 34). The following equation expresses this concept:

$$\Delta V_1=\Delta V_{T1}+\Delta V_{A1} \tag{1}$$

Similarly, the second current reduction voltage difference ($\Delta V_2$) 136 (e.g., the total voltage degradation of the pixel 34 when providing the second current ($I_2$) 104 across the diode 40 of the pixel 34) is the sum of the second temperature voltage difference ($\Delta V_{T2}$) 140 (e.g., the voltage degradation due to temperature variation at the pixel 34 when providing the second current ($I_2$) 104 across the diode 40 of the pixel 34) and the second current aging voltage difference 122 ($\Delta V_{A2}$) (e.g., the voltage degradation due to aging of the pixel 34 when providing the second current ($I_2$) 104 across the diode 40 of the pixel 34). The following equation expresses this concept:

$$\Delta V_2=\Delta V_{T2}+\Delta V_{A2} \tag{2}$$

Temperature Correlation Factor $\alpha$ and Aging Correlation Factor $\beta$

A temperature correlation factor $\alpha$ may be determined that relates the first temperature voltage difference 138 to the second temperature voltage difference 140. The following equation expresses this concept:

$$\Delta V_{T2}=\alpha\Delta V_{T1} \tag{3}$$

Similarly, an aging correlation factor $\beta$ may be determined that relates the first current aging voltage difference 118 and the second current aging voltage difference 122. The following equation expresses this concept:

$$\Delta V_{A2}=\beta\Delta V_{A1} \tag{4}$$

As such, Equation 2 above may be expressed the following:

$$\Delta V_2=\alpha\Delta V_{T1}+\beta\Delta V_{A1} \tag{5}$$

The temperature correlation factor $\alpha$ may be a correlation coefficient determined based on voltages supplied to the pixel 34 that cause different currents across the diode 40 of the pixel 34 at certain temperatures at the pixel 34. In particular, the temperature correlation factor $\alpha$ may be determined based on voltages supplied to the pixel 34 that cause the first current ($I_1$) 102 and the second current ($I_2$) 104 across the diode 40 of the pixel 34 (e.g., for various temperatures or ranges of temperatures at the pixel 34). In some cases, the temperature correlation factor $\alpha$ may be determined at an initial age (e.g., zero years) of the pixel 34 during which the display 5 is at a manufacturer's facility and before the electronic device 1 has been operated by a consumer.

For example, at the initial age of the pixel 34 and a control temperature at the pixel 34, the first initial voltage 106 may be determined that causes the first current ($I_1$) 102 across the diode 40 of the pixel 34, and the second initial voltage 108 may be determined that causes the second current ($I_2$) 104 across the diode 40 of the pixel 34. The temperature may then be varied (such that it is different than the control temperature), while the pixel 34 is still at the initial age, and the temperature correlation factor $\alpha$ may be determined based on the voltage supplied to the pixel 34 that causes the first current ($I_1$) 102 across the diode 40 of the pixel 34 and the voltage supplied to the pixel 34 that causes the second current ($I_2$) 104 across the diode 40 of the pixel 34. In particular, since there is no voltage degradation due to aging of the pixel 34, the following equation may be used to determine the temperature correlation factor $\alpha$:

$$\alpha=\Delta V_2/\Delta V_1 \tag{5}$$

The manufacturer may vary temperature at the pixel 34 (as well as other pixels 34 and/or pixel groups of the display 5), and, for each temperature (and each pixel 34 and/or pixel group), determine a corresponding temperature correlation factor. The manufacturer may then store the determined temperature correlation factors in a memory or storage device (such as the local memory and/or main memory storage device 3).

The aging correlation factor $\beta$ may be a correlation coefficient determined based on voltages supplied to the pixel 34 that cause different currents across the diode 40 of the pixel 34 at certain ages of the pixel 34. In particular, the aging correlation factor $\beta$ may be determined based on voltages supplied to the pixel 34 that cause the first current ($I_1$) 102 and the second current ($I_2$) 104 across the diode 40 of the pixel 34 (e.g., for various ages or ranges of ages of the pixel 34). In some cases, the aging correlation factor $\beta$ may be determined based on device physics of the display 5 and/or the pixel 34, such as how the display 5 is built, how circuitry in the display 5 and/or the pixel 34 is laid out, materials (and characteristics of the materials) used in the display 5 and/or the pixel 34, and so forth. In additional or alternative cases, the aging correlation factor $\beta$ may be determined based on panel characterization of the display 5, such as by intentionally aging the pixel 34 and maintaining the temperature at the pixel 34 (e.g., at a manufacturer's facility and before the electronic device 1 has been operated by a consumer), and determining the aging correlation factor β based on the voltage supplied to the pixel 34 that causes the first current ($I_1$) 102 across the diode 40 of the pixel 34 and the voltage supplied to the pixel 34 that causes the second current ($I_2$) 104 across the diode 40 of the pixel 34. Moreover, the aging correlation factor β may be determined and/or updated as the pixel 34 ages (e.g., periodically) during the lifetime of the display 5 to more accurately characterize the nature of the voltage degradation characterization of the pixel 34 due to aging, based on the voltage supplied to the pixel 34 that causes the first current ($I_1$) 102 across the diode 40 of the pixel 34 and the voltage supplied to the pixel 34 that causes the second current ($I_2$) 104 across the diode 40 of the pixel 34. In particular, if it can be assumed that there is no temperature variation at the pixel 34, and thus no current-voltage shift due to temperature variation at the pixel 34, the following equation may be used to determine the aging correlation factor β:

$$\beta=\Delta V_2/\Delta V_1 \tag{6}$$

In some embodiments, the aging correlation factor β may be determined or calculated by applying a high pass filter to multiple current-voltage shift values for multiple pixels 34 of the display 5. Because applying the high pass filter may remove low frequency values (e.g., values for pixels 34 that are likely not at a same target temperature), the temperature terms (e.g., the first temperature voltage difference 138 ($\Delta V_{T1}$) and the second temperature voltage difference 140 ($\Delta V_{T2}$) may be removed when determining or calculating the aging correlation factor β. As such, the following equation may be used to determine the aging correlation factor β using a high pass filter (HPF):

$$\beta=\mathrm{HPF}(\Delta V_2)/\mathrm{HPF}(\Delta V_1) \tag{7}$$

The voltage degradation due to aging of a pixel 34 may be determined by solving for the first current aging voltage difference 118 ($\Delta V_{A1}$) and the second current aging voltage difference 122 ($\Delta V_{A2}$) in Equations 1 and 5, as shown in the following:

$$\Delta V_{A1}=(\alpha\Delta V_1-\Delta V_2)/(\alpha-\beta) \tag{8}$$

$$\Delta V_{A2}=\beta\Delta V_{A1}=\beta(\alpha\Delta V_1-\Delta V_2)/(\alpha-\beta) \tag{9}$$

By determining the first current aging voltage difference 118 ($\Delta V_{A1}$) and the second current aging voltage difference 122 ($\Delta V_{A2}$) as shown in Equations 8 and 9, the current-voltage shift determination circuitry 72, for example, may generate the aging curve 110 as illustrated in FIG. 8. The current-voltage shift determination circuitry 72 may then determine a voltage degradation value on the aging curve 110 corresponding to a current value desired across the diode 40 ($I_{ds}$) of the pixel 34 (as represented by the vertical axis 94 of FIG. 8). In this manner, voltage degradation due to pixel aging may be determined separately from current-voltage shift due to temperature, and, as such, be more accurately compensated for, resulting in better display of image data. The current-voltage shift determination circuitry 72 may thus perform voltage degradation compensation based on the age of the pixel 34 and current-voltage shift compensation based on a temperature sensed at the pixel 34 (e.g., by the analog front end 68), instead of by constantly sensing current across the diode 40 of the pixel 34.

Non-Uniformity in Correlation Factors

In some embodiments, a temperature correlation factor α and an aging correlation factor β may be determined and stored in a memory or storage device (such as the local memory and/or main memory storage device 3) for each pixel 34 of the display 5. In additional or alternative embodiments, a temperature correlation factor α and an aging correlation factor β may be determined and stored for pixel groups of the display 5. For example, for each pixel 34 in a pixel group (which may include any suitable number and/or configuration of pixels 34, such as a 3×3 array of pixels 34, an 8×10 array of pixels 34, and other similar groupings), a respective temperature correlation factor α and a respective aging correlation factor β may be determined. An average temperature correlation factor α and an average aging correlation factor β may then be determined based on the respective temperature correlation factors α and the respective aging correlation factors (3, respectively, and stored for the pixel group.

In one embodiment, the current-voltage shift determination circuitry 72 may determine a respective temperature correlation factor α and a respective aging correlation factor β for each pixel 34 of the display 5, and then determine an average temperature correlation factor $\alpha_0$ and an average aging correlation factor $\beta_0$ for the pixels 34 of the display 5 based on the respective temperature correlation factors α and the respective aging correlation factors β, respectively.

Because each pixel 34 of the display 5 may be physically different from each other (e.g., due to differences in circuitry layout, materials, location in the display 5, manufacturing imperfections, or for similar reasons), each pixel 34 may not have the same temperature correlation factor α or aging correlation factor β. Similarly, errors in sensing (e.g., voltage supplied to the pixel 34 and/or current across the diode 40 of the pixel 34) may also lead to non-uniform temperature correlation factors α or aging correlation factors β from pixel 34 to pixel 34.

To compensate for non-uniformity in temperature correlation factors α or aging correlation factors β from pixel 34 to pixel 34, instead of directly determining the first current aging voltage difference 118 ($\Delta V_{A1}$) as shown in Equation 8, the current-voltage shift determination circuitry 72 may first determine calculated or compensated current-voltage shift due to temperature variation at the pixel 34 that compensates for the difference between the temperature correlation factor α of the pixel 34 and the average temperature correlation factor $\alpha_0$ and/or the difference between the aging correlation factor β of the pixel 34 and the average aging correlation factor $\beta_0$. The current-voltage shift determination circuitry 72 may then extract (e.g., subtract) the calculated current-voltage shift due to temperature variation from the total current-voltage shift of the pixel 34 (e.g., the current reduction voltage difference) to determine the voltage degradation due to aging of the pixel 34.

As an example, the current-voltage shift determination circuitry 72 may attempt to determine the voltage degradation due to aging of the pixel 34 in the voltage supplied to the pixel 34 when providing the first current ($I_1$) 102 across the diode 40 of the pixel 34, the voltage degradation due to aging of a pixel 34. As such, the current-voltage shift determination circuitry 72 may first solve for an average voltage degradation due to temperature variation ($\Delta V_{T1_Avg}$) in Equations 1 and 5 using the average temperature correlation factor $\alpha_0$ and the average aging correlation factor $\beta_0$, as shown in the Equation below:

$$\Delta V_{T1_Avg}=(\Delta V_2-\beta_0\Delta V_1)/(\alpha_0-\beta_0) \tag{10}$$

The current-voltage shift determination circuitry 72 may then determine the calculated or compensated current-voltage shift due to temperature variation at the pixel 34

($\Delta V_{T1_Cal}$) that compensates for the difference between the temperature correlation factor $\alpha$ of the pixel 34 and the average temperature correlation factor $\alpha_0$ by replacing $\Delta V_1$ and $\Delta V_2$ in Equation 10 with Equations 1 and 5 to enable the temperature correlation factor $\alpha$ and the aging correlation factor $\beta$ of the pixel 34 to be inserted into Equation 10, as shown in the Equation below:

$$\Delta V_{T1_Cal}=\Delta V_{T1}(\alpha-\beta_0)/(\alpha_0-\beta_0)+\Delta V_{A1}(\beta-\beta_0)/(\alpha_0-\beta_0) \quad (11)$$

As can be seen in Equation 11, if the temperature correlation factor $\alpha$ of the pixel 34 is the same as the average temperature correlation factor $\alpha_0$, and the aging correlation factor $\beta$ of the pixel 34 is the same as the average aging correlation factor $\beta_0$, the calculated current-voltage shift due to temperature variation at the pixel 34 ($\Delta V_{T1_Cal}$) will equal $\Delta V_{T1}$, or the average current-voltage shift due to temperature variation ($\Delta V_{T1_Avg}$).

The current-voltage shift determination circuitry 72 may then extract or subtract the calculated current-voltage shift due to temperature variation at the pixel 34 ($\Delta V_{T1_Cal}$) from the total current-voltage shift of the pixel 34 (e.g., the first current reduction voltage difference ($\Delta V_1$) 132) to determine a calculated voltage degradation due to aging of the pixel 34 ($\Delta V_{A1_Cal}$), as shown in the following equation:

$$\Delta V_{A1_Cal}=\Delta V_1-\Delta V_{T1_Cal} \quad (12)$$

In this manner, non-uniformity in temperature correlation factors $\alpha$ and/or aging correlation factors $\beta$ may be mitigated by averaging temperature correlation factors $\alpha$ and/or aging correlation factors $\beta$ for multiple pixels 34.

Mitigating Non-Uniformity in Correlation Factors for Pixels in which Temperature Change Causes a Uniform Change in Voltage The current-voltage shift determination circuitry 72 may solve for the voltage degradation due to aging of the pixel 34 (e.g., the first current aging voltage difference ($\Delta V_{A1}$) 118) in Equation 12 for each pixel 34 of the display 5. However, it may be a resource intensive task to solve for the voltage degradation due to aging for each pixel 34 of the display 5. As such, the current-voltage shift determination circuitry 72 may instead estimate the voltage degradation due to aging for a pixel group (e.g., a pixel 34 and its neighboring pixels 34). It should be understood that a pixel group may include any suitable number and/or configuration of pixels 34, such as a 3×3 array of pixels 34, an 8×10 array of pixels 34, a 30×50 array of pixels 34, and other similar groupings). Accuracy of determining the voltage degradation may be maintained, despite estimating voltage degradation for a pixel group, because the current-voltage shift due to temperature variation of the pixel group may first be determined (and then extracted from the total voltage degradation), and the temperature at a pixel 34 is likely to also be experienced by neighboring pixels 34 (e.g., of the pixel group.

In some cases, it may be determined (e.g., at a manufacturer's facility and before the electronic device 1 has been operated by a consumer) that temperature variation results in an approximately uniform voltage shift for the pixel group. That is, the change in current-voltage shift to provide a certain current at a pixel 34 varies as a function of temperature (e.g., $\Delta V_{T1}=f(\Delta T)$. As such, the current-voltage shift determination circuitry 72 may average the calculated current-voltage shift due to temperature variation at each pixel 34 of the pixel group ($\Delta V_{T1_Cal}$), as shown in the Equation below.

$$\text{avg}(\Delta V_{T1_Cal})=\text{avg}((\alpha-\beta_0)/(\alpha_0-\beta_0))\Delta V_{T1}+\text{avg}(((\beta-\beta_0)/(\alpha_0-\beta_0))\Delta V_{A1}) \quad (13)$$

The current-voltage shift determination circuitry 72 may then extract the average calculated current-voltage shift due to temperature variation (avg ($\Delta V_{T1_Cal}$)) from the total voltage degradation ($\Delta V_1$) to determine a calculated current-voltage shift due to aging of the pixel 34 ($\Delta V_{A1_Cal}$), as shown in the Equations below:

$$\Delta V_{A1_Cal}=\Delta V_1-\text{avg}(\Delta V_{T1_Cal}) \quad (14)$$

$$\Delta V_{A1_Cal}=\Delta V_1-\text{avg}((\Delta V_2-\beta_0\Delta V_1)/(\alpha_0-\beta_0)) \quad (15)$$

In this manner, non-uniformity in temperature correlation factors $\alpha$ and/or aging correlation factors $\beta$ may be mitigated by averaging the calculated current-voltage shift due to temperature variation ($\Delta V_{T1_Cal}$) at each pixel 34 of a pixel group when temperature variation results in an approximately uniform voltage shift for the pixel group.

Mitigating Non-Uniformity in Correlation Factors for Pixels in which Temperature Change Causes a Uniform Change in Current In additional or alternative cases, it may be determined (e.g., at a manufacturer's facility and before the electronic device 1 has been operated by a consumer) that temperature variation results in an approximately uniform current or current percentage shift for the pixel group. That is, there is a change in current or current percentage across the diode 40 of the pixel 34 when a certain voltage is provided to the pixel 34 that varies as a function of temperature (e.g., $\Delta I/I=f(\Delta T)$). As such, the current-voltage shift determination circuitry 72 may first convert the calculated current-voltage shift due to temperature variation at each pixel 34 of the pixel group ($\Delta V_{T1_Cal}$) to a respective calculated resulting current across the diode 40 of each pixel 34 ($\Delta I_{T1_Cal}$), as shown in the following equation:

$$\Delta I_{T1_Cal}=F(\Delta V_{T1_Cal}) \quad (16)$$

The conversion function "F" denoted in Equation 16 may be convert a voltage value to a current value based on voltage-current relationships or curves that relate voltage supplied to each pixel 34 and the resulting current across the diode 40 of the pixel 34 for a range of temperatures. This is because each pixel 34 may have a different voltage-current relationship or curve due to varying physical characteristics and/or manufacturing imperfections. Such voltage-current relationships or curves may be stored (e.g., as a look-up table) in a memory or storage device (such as the local memory and/or main memory storage device 3) for each pixel 34 for a range of temperatures. The calculated current-voltage shift due to temperature variation at each pixel 34 of the pixel group ($\Delta V_{T1_Cal}$) may be determined as expressed in Equation 11.

The current-voltage shift determination circuitry 72 may then average the calculated resulting current ($\Delta I_{T1_Cal}$) for each pixel 34, as shown in the following equation:

$$\text{avg}(\Delta I_{T1_Cal})=\text{avg}(F(\Delta V_{T1_Cal})) \quad (17)$$

The current-voltage shift determination circuitry 72 may convert the average calculated resulting current ($\Delta I_{T1_Cal}$) back to the voltage domain to determine an average calculated current-voltage shift value due to temperature variation group ($\Delta V_{T1_Cal}$) for each pixel 34. The voltage-current relationships or curves that relate voltage supplied to each pixel 34 and the resulting current across the diode 40 of the pixel 34 for a range of temperatures that are stored (e.g., as a look-up table) in the local memory and/or main memory storage device 3 may be used to perform this conversion. The equation to convert the average calculated resulting current ($\Delta I_{T1_Cal}$) back to the voltage domain is shown below:

$$\Delta V'_{T1_Cal}=F^{-1}(\text{avg}(F(\Delta V_{T1_Cal}))) \quad (18)$$

The current-voltage shift determination circuitry 72 may then extract the average current-voltage shift degradation due to temperature variation (avg ($\Delta V_{T1_Cal}$)) from the total current-voltage shift ($\Delta V_1$) to determine a calculated current-voltage shift due to aging of the pixel 34 ($\Delta V_{A1_Cal}$), as shown in the Equations below.

$$\Delta V_{A1_Cal}=\Delta V_1-\Delta V'_{T1_Cal} \tag{19}$$

$$\Delta V_{A1_Cal}=\Delta V_1-F^{-1}(\text{avg}(F(\Delta V_{T1_Cal} \tag{20}$$

In this manner, non-uniformity in temperature correlation factors α and/or aging correlation factors β may be mitigated by averaging the calculated resulting current ($\Delta I_{T1_Cal}$) for each pixel 34 when temperature variation results in an approximately uniform current or current percentage shift for the pixel group.

Method for Voltage Degradation Compensation

Figure 9:
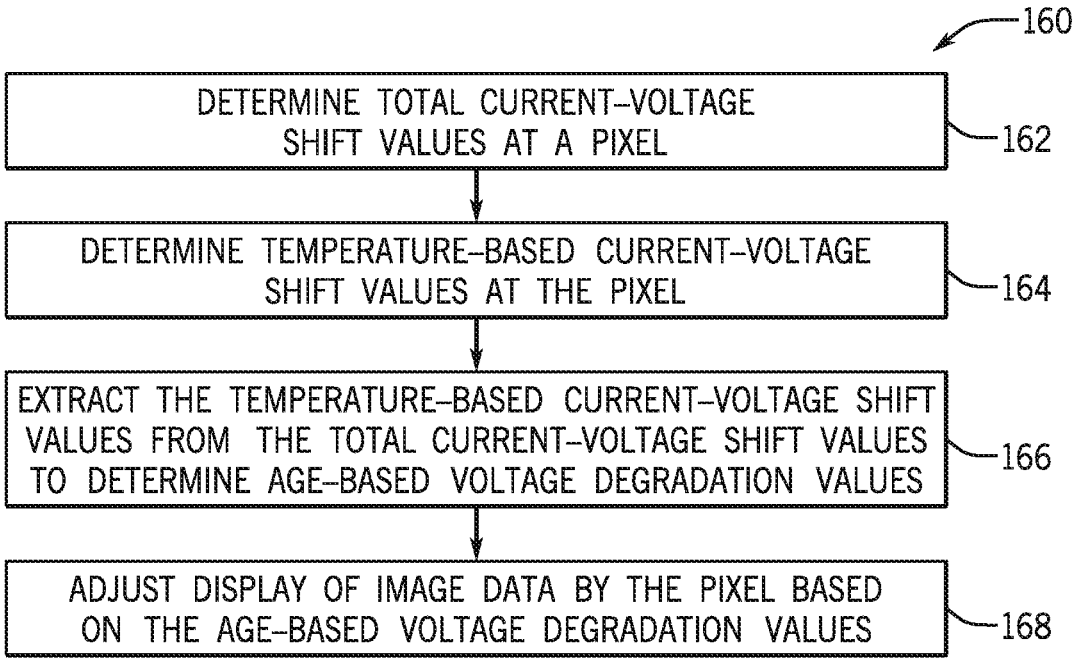
FIG. 9 is a flow diagram of a method for compensating for voltage degradation of a pixel, according to an embodiment of the present disclosure.

FIG. 9 is a flow diagram of a method 160 for compensating for voltage degradation, according to an embodiment of the present disclosure. While the method 160 is described using steps in a specific sequence, it should be understood that the present disclosure contemplates that the described steps may be performed in different sequences than the sequence illustrated, and certain described steps may be skipped or not performed altogether. In some embodiments, at least some of the steps of the method 160 may be performed by the display compensation circuitry 52 and the current-voltage shift determination circuitry 72, as described below. However, it should be understood that any suitable device or combination of devices is contemplated to perform the method 160, such as the processing circuitry 2, the driver integrated circuitry 64, and/or other similar components of the system 50 for voltage degradation compensation illustrated in FIG. 8.

In block 162, the current-voltage shift determination circuitry 72 may determine total current-voltage shift values at a pixel 34. For example, at an initial age (e.g., zero years) of the pixel 34 (e.g., at which the display 5 is at a manufacturer's facility and before the electronic device 1 has been operated by a consumer), the display compensation circuitry 52 may send first image data 60 (e.g., test image data) to the pixel 34, and instruct the analog-to-digital converter 66 to supply voltage to the pixel 34 at multiple initial voltages. The analog front end 68 may sense the resulting currents across the diode 40, and send the resulting currents as the display sense feedback 70 to the current-voltage shift determination circuitry 72. The processing circuitry 2 may save these resulting currents in a memory or storage device (such as the local memory and/or main memory storage device 3) as target or expected currents. At a later age of the pixel 34 (e.g., after which the electronic device 1 has been purchased and operated by the consumer), the display compensation circuitry 52 may send the first image data 60 (e.g., test image data) to the pixel 34, and instruct the analog-to-digital converter 66 to supply voltage to the pixel 34 at multiple voltages that result in the resulting currents across the diode 40. The current-voltage shift determination circuitry 72 may determine the differences between the multiple voltages (determined at the later age of the pixel 34) and the multiple initial voltages (determined at the initial age of the pixel 34) as total current-voltage shift values of the pixel 34.

In block 164, the current-voltage shift determination circuitry 72 may determine temperature-based current-voltage shift values at the pixel 34. For example, the current-voltage shift determination circuitry 72 may use Equations 1 and 5 and solve for the first temperature voltage difference ($\Delta V_{T1}$) 138 to determine the temperature-based current-voltage shift values at the pixel 34.

In some embodiments, because each pixel 34 of the display 5 may be physically different from each other (e.g., due to differences in circuitry layout, materials, location in the display 5, manufacturing imperfections, or for similar reasons), each pixel 34 may not have the same temperature correlation factor α or aging correlation factor β. Similarly, errors in sensing (e.g., voltage supplied to the pixel 34 and/or current across the diode 40 of the pixel 34) may also lead to non-uniform temperature correlation factors α or aging correlation factors β from pixel 34 to pixel 34. As such, the current-voltage shift determination circuitry 72 may use an averaged temperature correlation factor $\alpha_0$ and/or an averaged aging correlation factor $\beta_0$ to determine the temperature-based current-voltage shift values at the pixel 34 (e.g., using Equation 10).

In additional or alternative embodiments, non-uniformity of the temperature correlation factors α or aging correlation factors β may be mitigated for by factoring in the temperature correlation factors α or aging correlation factors β of at least some pixels 34. For example, the current-voltage shift determination circuitry 72 may use Equation 11 to calculate the temperature-based current-voltage shift values at the pixel 34 by factoring in the temperature correlation factors α or aging correlation factors β of the pixel 34 (or a neighboring pixel 34). In this manner, non-uniformity in temperature correlation factors α and/or aging correlation factors β may be mitigated by averaging temperature correlation factors α and/or aging correlation factors β for multiple pixels 34.

In some embodiments, when temperature variation results in an approximately uniform voltage shift for the pixel group, non-uniformity in temperature correlation factors α and/or aging correlation factors β may be mitigated by averaging the calculated current-voltage shift due to temperature variation ($\Delta V_{T1_Cal}$) at each pixel 34 of a pixel group. In particular, the current-voltage shift determination circuitry 72 may use Equation 15 to calculate the temperature-based current-voltage shift values at the pixel 34 by averaging the calculated current-voltage shift due to temperature variation ($\Delta V_{T1_Cal}$) at each pixel 34 of the pixel group.

In one embodiment, when temperature variation results in an approximately uniform current or current percentage shift for the pixel group, non-uniformity in temperature correlation factors α and/or aging correlation factors β may be mitigated by averaging the calculated current-voltage shift due to temperature variation ($\Delta V_{T1_Cal}$) at each pixel 34 of a pixel group. In particular, the current-voltage shift determination circuitry 72 may use Equation 20 to calculate the temperature-based current-voltage shift values at the pixel 34 by averaging the calculated current-voltage shift due to temperature variation ($\Delta V_{T1_Cal}$) at each pixel 34 of the pixel group.

In block 166, the current-voltage shift determination circuitry 72 may extract the temperature-based current-voltage shift values at the pixel 34 determined in block 164 from the current-voltage shift values determined in block 162 to determine age-based voltage degradation values. This is generally shown in Equation 12, and shown in light of specific embodiments in Equations 14, 15, 19, and 20.

In block 168, the display compensation circuitry 52 may adjust display of image data by the pixel 34 based on the age-based voltage degradation values determined in block 166. In particular, the processing circuitry 2 may store the age-based voltage degradation values and/or compensation values based on the age-based voltage degradation values in a memory or storage device (such as the local memory and/or main memory storage device 3). When the display compensation circuitry 52 next sends image data 60 to the display 5 to be displayed by the pixel 34, the display compensation circuitry 52 may also send a voltage adjustment signal 76 based on the stored age-based voltage degradation values/compensation values to the display 5 that instructs the analog-to-digital converter 66 to adjust the voltage supplied to the pixel 34 to compensate for aging of the pixel 34.

In some embodiments, the display compensation circuitry 52 may also adjust display of image data by the pixel 34 based on the temperature-based current-voltage shift values determined in block 164. In additional or alternative embodiments, the analog front end 68 may sense temperature at or near the pixel 34, and the display compensation circuitry 52 may adjust display of image data by the pixel 34 based on a stored relationship (e.g., a look-up table) relating the temperature to temperature-based current-voltage shift (e.g., stored in a memory or storage device (such as the local memory and/or main memory storage device 3).

In this manner, voltage degradation due to pixel aging may be determined separately from current-voltage shift due to temperature, and, as such, be more accurately compensated for, resulting in better display of image data. The current-voltage shift determination circuitry 72 may thus perform voltage degradation compensation based on the age of the pixel 34 and current-voltage shift compensation based on a temperature sensed at the pixel 34 (e.g., by the analog front end 68), instead of by constantly sensing current across the diode 40 of the pixel 34.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A electronic device comprising:

a display comprising a pixel;

processing circuitry separate from but communicatively coupled to the display, wherein the processing circuitry is configured to prepare image data to send to the pixel, wherein processing circuitry comprises:

current-voltage shift determination circuitry configured to:

determine a first voltage difference between a first voltage configured to cause the pixel to conduct a first current at a first time and a second voltage configured to cause the pixel to conduct the first current at a second time after the first time;

determine a second voltage difference between a third voltage configured to cause the pixel to conduct a second current at a third time and a fourth voltage configured to cause the pixel to conduct the second current at a fourth time different from the third time;

determine a set of total current-voltage shift values at the pixel based on the first voltage difference and the second voltage difference;

apply a filter to the set of total current-voltage shift values to determine an aging correlation factor associated with the display;

determine a set of age-based voltage degradation values attributable to aging at the pixel from the set of total current-voltage shift values at the pixel based on the aging correlation factor; and display compensation circuitry configured to adjust voltage supplied to the pixel, wherein the voltage is configured to cause the pixel to display the image data based at least in part on the set of age-based voltage degradation values.

2. The electronic device of claim 1, wherein the filter comprises a high pass filter.

3. The electronic device of claim 1, wherein the processing circuitry is configured to determine a set of temperature-based current-voltage shift values attributable to temperature variation at the pixel from the set of total current-voltage shift values at the pixel.

4. The electronic device of claim 3, wherein the display compensation circuitry is configured to adjust the voltage configured to cause the pixel to display the image data based at least in part on the set of temperature-based current-voltage shift values.

5. A method comprising:

determining, via processing circuitry coupled to an electronic display comprising a pixel, a set of total current-voltage shift values at the pixel;

receiving, via the processing circuitry, a temperature value associated with the pixel from a sensor disposed within a pixel circuit configured to provide a current to a light-emitting diode associated with the pixel;

retrieving, via the processing circuitry, one or more temperature correlation factors based on the temperature value from a memory component;

applying, via the processing circuitry, the one or more temperature correlation factors to the set of total current-voltage shift values to determine an updated set of total current-voltage shift values;

extracting, via the processing circuitry, a set of temperature-based current voltage shift values from the updated set of total current-voltage shift values to determine a set of age-based voltage degradation values attributable to aging at the pixel, wherein the set of temperature-based current voltage shift values is attributable to a temperature variation at the pixel; and adjusting, via the processing circuitry, voltage configured to cause the pixel to display image data based at least in part on the set of age-based voltage degradation values.

6. The method of claim 5, comprising determining whether varying temperature causes an initial set of current-voltage shift values to change uniformly for the pixel and pixels neighboring the pixel at an initial age of the pixel and pixels neighboring the pixel.

7. The method of claim 6, comprising determining, via the processing circuitry, additional sets of temperature-based current-voltage shift values attributable to temperature variation for the pixels neighboring the pixel in response to determining, via the processing circuitry, that varying temperature causes the initial set of current-voltage shift values to change uniformly for the pixel and the pixels neighboring the pixel at the initial age of the pixel and pixels neighboring the pixel.

8. The method of claim 7, comprising determining, via the processing circuitry, a set of average temperature-based current-voltage shift values based at least in part on the set of temperature-based current-voltage shift values and the additional sets of temperature-based current-voltage shift values, wherein extracting, via the processing circuitry, the set of temperature-based current-voltage shift values from the set of total current-voltage shift values to determine the set of age-based voltage degradation values at the pixel comprises extracting, via the processing circuitry, the set of average temperature-based current-voltage shift values from the set of total current-voltage shift values.

9. The method of claim 5, comprising determining whether varying temperature causes current over diodes of the pixel and pixels neighboring the pixel to change uniformly at an initial age of the pixel and pixels neighboring the pixel.

10. The method of claim 9, comprising determining, via the processing circuitry, additional sets of temperature-based current-voltage shift values for the pixels neighboring the pixel in response to determining, via the processing circuitry, that varying temperature causes the current over the diodes of the pixel and pixels neighboring the pixel to change uniformly.

11. The method of claim 10, comprising determining, via the processing circuitry, a set of average temperature-based current reduction values based at least in part on the set of temperature-based current-voltage shift values and the additional sets of temperature-based current-voltage shift values.

12. The method of claim 11, wherein determining, via the processing circuitry, the set of average temperature-based current reduction values comprises:

converting, via the processing circuitry, the set of temperature-based current-voltage shift values and the additional sets of temperature-based current-voltage shift values into sets of temperature-based current reduction values; and averaging, via the processing circuitry, the sets of temperature-based current reduction values to determine the set of average temperature-based current reduction values.

13. The method of claim 11, comprising converting, via the processing circuitry, the set of average temperature-based current reduction values to respective sets of temperature-based current-voltage shift values for each of the pixel and the pixels neighboring the pixel, wherein extracting, via the processing circuitry, the set of temperature-based current-voltage shift values from the set of total current-voltage shift values to determine the set of age-based voltage degradation values comprises extracting, via the processing circuitry, the respective sets of temperature-based current-voltage shift for each of the pixel and the pixels neighboring the pixel from the set of total current-voltage shift values to determine the set of age-based voltage degradation values for each of the pixel and the pixels neighboring the pixel.

14. Processing circuitry communicatively coupled to an electronic display, wherein the electronic display comprises a pixel, wherein the processing circuitry is configured to:

send first image data to the pixel;

determine a first voltage difference between a first voltage configured to cause the pixel to conduct a first current at a first time and a second voltage configured to cause the pixel to conduct the first current at a second time after the first time;

determine a second voltage difference between a third voltage configured to cause the pixel to conduct a second current at a third time and a fourth voltage configured to cause the pixel to conduct the second current at a fourth time different from the third time;

determine a set of total current-voltage shift values at the pixel based on the first voltage difference and the second voltage difference;

apply a filter to the set of total current-voltage shift values to determine an aging correlation factor associated with the display;

determine a set of age-based voltage degradation values at the pixel from the set of total current-voltage shift values based on the aging correlation factor;

send second image data to the pixel; and adjust voltage configured to cause the pixel to display the second image data based at least in part on the set of age-based voltage degradation values.

15. The processing circuitry of claim 14, wherein the processing circuitry is configured to determine the set of total current-voltage shift values at the pixel based at least in part on a temperature correlation factor and an aging correlation factor.

16. The processing circuitry of claim 15, wherein the temperature correlation factor is determined based at least in part on device physics of the electronic display, age testing of the electronic display, age sensing of the electronic display, or any combination thereof.

17. The processing circuitry of claim 15, wherein the electronic display comprises a plurality of pixels, wherein the aging correlation factor comprises an average of a plurality of aging correlation factors determined for the plurality of pixels.

18. The electronic device of claim 1, wherein the processing circuitry is configured to determine the set of total current-voltage shift values at the pixel based at least in part on a temperature correlation factor and the aging correlation factor.

19. The electronic device of claim 18, wherein the electronic display comprises a plurality of pixels, wherein the aging correlation factor comprises an average of a plurality of aging correlation factors determined for the plurality of pixels.

20. The processing circuitry of claim 14, wherein the filter applied to the set of total current-voltage shift values to determine the aging correlation factor comprises a high pass filter.

* * * * *